United States Patent [19]

Jewett, Sr.

[11] Patent Number: 4,802,661

[45] Date of Patent: Feb. 7, 1989

[54] METHOD AND APPARATUS FOR PRODUCING EYEGLASS FRAMES

[76] Inventor: Bryce D. Jewett, Sr., 2901 Maury St., Richmond, Va. 23224

[21] Appl. No.: 145,892

[22] Filed: Jan. 20, 1988

[51] Int. Cl.[4] ..... B23Q 3/14

[52] U.S. Cl. ..... 269/48.1; 269/60; 269/157; 269/217; 269/266; 269/909

[58] Field of Search ..... 269/47, 48.1, 50, 51, 269/52, 60, 104, 152, 157, 217, 240, 246, 266, 909; 279/2 R; 242/72 R, 72.1, 72 B; 82/44

[56] References Cited

U.S. PATENT DOCUMENTS

| | | | |
|---|---|---|---|
| 2,623,423 | 12/1952 | Horvath . | |
| 3,604,700 | 9/1971 | Gault | 269/266 |
| 3,710,653 | 1/1973 | Miller . | |
| 3,782,740 | 1/1974 | Peyrot | 279/2 R |
| 4,047,709 | 9/1977 | Thyberg et al. | 269/266 |
| 4,078,283 | 3/1978 | Choquette . | |
| 4,519,620 | 5/1985 | Keith . | |
| 4,522,379 | 6/1985 | Lindgren . | |
| 4,711,406 | 12/1987 | Barstow | 292/72 R |

*Primary Examiner*—Robert C. Watson

*Attorney, Agent, or Firm*—Norman B. Rainer

[57] ABSTRACT

An eyeglass frame is produced from a plastic workpiece panel of elongated outer periphery having two lens-holding apertures, each aperture having a groove about its perimeter for receiving the lens of the eyeglass. The workpiece is placed upon a holder having two slidably adjustable chucks, each chuck having impingement structure which controllably engages the perimeter of the aperture. The impingement structure is driven in radially divergent directions toward the perimeter by pressure applied from balls housed within the chuck.

7 Claims, 4 Drawing Sheets

METHOD AND APPARATUS FOR PRODUCING EYEGLASS FRAMES

BACKGROUND OF THE INVENTION

This invention concerns a method for the production of an eyeglass frame from a mololithic plastic workpiece, and further relates to a holding apparatus useful in said method.

A widely used style of eyeglass frame is one vehicle the entire perimeter of each lens engages a rim which defines a holding aperture that completely surrounds the lens, said rims being disposed in substantially coplanar relationship and interconnected by a nosepiece portion representing a continuous integral extension of the rims. The frame is generally fabricated of plastic material. A pair of elongated arms adapted to engage the ears of the user are generally pivotably attached to the opposite extremities of the frame.

It has generally been found that although such frames can be made by injection molding, equipment costs are extremely high, particularly for mold design. Accordingly, injection molding methods are not utilized unless a high volume run of a single type and size frame is contemplated. Alternatively, frames can be made by a milling operation. The units costs in the milling method are higher than the molding method because of the considerable time required per frame, but the equipment costs are much lower and the versatility is significantly greater.

The milling method of frame-making is generally conducted upon a flat starting blank such as a slab of cellulose acetate. Techniques and equipment heretofore disclosed for speeding the milling operation have compromised the quality of the resultant frame product. A primary aspect of the milling operation involves the precision securement of the workpiece within a holder device which facilitates accurate milling.

It is accordingly an object of the present invention to provide a holder apparatus for rapidly engaging a plastic slab workpiece, holding the workpiece accurately during a milling operation which forms the workpiece into an eyeglass frame, and rapidly releasing said frame.

It is another object of this invention to provide a holder as in the foregoing object useful in producing eyeglass frames of varied size and shape.

It is a further object of the present invention to provide a method for producing an eyeglass frame from a plastic workpiece utilizing apparatus of the aforesaid general nature.

These objects and other objects and advantages of the invention will be apparent from the following description.

SUMMARY OF THE INVENTION

The above and other beneficial objects and advantages are accomplished in accordance with the present invention by an apparatus for holding a plastic workpiece panel of elongated outer periphery for the production of an eyeglass frame, said panel having two lens-holding apertures of mirror image identity substantially centered upon the axis of elongation of the panel, each having a groove circumscribing its entire perimeter centered within the thickness of the panel and adapted to receive the edges of the lenses which will be inserted into the finished frame, said apparatus comprising:

(a) a rigid base having means for attachment to an underlying substrate, (b) paired chuck assemblies of mirror image identity slideably positionable upon said base along a common horizontal axis, (c) means for causing sliding motion of said chuck assemblies upon said base, (d) means for locking each chuck assembly in a desired location upon said base, (e) each chuck assembly comprising:

(1) a housing having a lower portion which engages said motion causing means, an upper portion having a chamber which confines a multitude of ball bearings, said chamber having an upwardly directed opening, a cylindrical threaded hub disposed above said opening and having a hollow interior that communicates with said chamber, and slots oriented in vertical planes radially emergent from said opening, (2) first holding means laterally positionable in a direction perpendicular to said common horizontal axis and adapted to engage the groove within and aperture of said workpiece panel, (3) second holding means adapted to engage the groove within an aperture of said workpiece panel at a site closest to the other aperture, said site ultimately becoming the nosepiece of the eyeglass frame, the concerted action of the second holding means of the two chuck assemblies being to limit the separation between the two assemblies against the urging of said means for causing sliding motion along said horizontal axis, (4) a number of impingement means moveable radially with respect to said hub, and adapted to contact the workpiece panel at different sites within the apertures thereof, each impingement means being supported by an underlying traveling plate communicating with said chamber and constrained to slide within said slots, and (5) closure means which treadably engages said hub and, by rotation moves downwardly to apply force to the multitude of ball bearings, whereby (f) said traveling plates are independently driven radially outwardly from said hub, carrying said impingement means which abut with equal force against the perimeter of the aperture, whereby (g) the workpiece panel is securely and precisely held without distortion in a manner to permit milling of its outer periphery to product the sought eyeglass frame.

In preferred embodiments, substantially all components of the apparatus are fabricated of steel or other metals of equivalent machinability and wear resistance. The percision of the sliding interaction of the base with the chuck assemblies is preferably assured by way of tongue and groove track structure operative between the upper surface of the base and lower portion of the chuck assemblies.

In further preferred embodiments, means are provided to limit the extent of outward radial movement of the traveling plates. Means may also be provided to cause the upper extremity of each traveling plate to tilt slightly in the radially outward direction, thereby mechanically locking its position by virture of abutment with structure interacting with upper and lower portions of the traveling plate.

Although, for ease of description, the terms "horizontal", "lateral" and "vertical" have been used, it is to be understood that the apparatus of this invention may be utilized in any orientation.

BRIEF DESCRIPTION OF THE DRAWINGS

For a fuller understanding of the nature and objects of the invention, reference should be had to the following detailed description taken in connection with the accompanying drawing forming a part of this specification and in which similar numerals of reference indicate corresponding parts in all the figures of the drawing.

DESCRIPTION OF THE PREFERRED EMBODIMENTS

Figure 1:
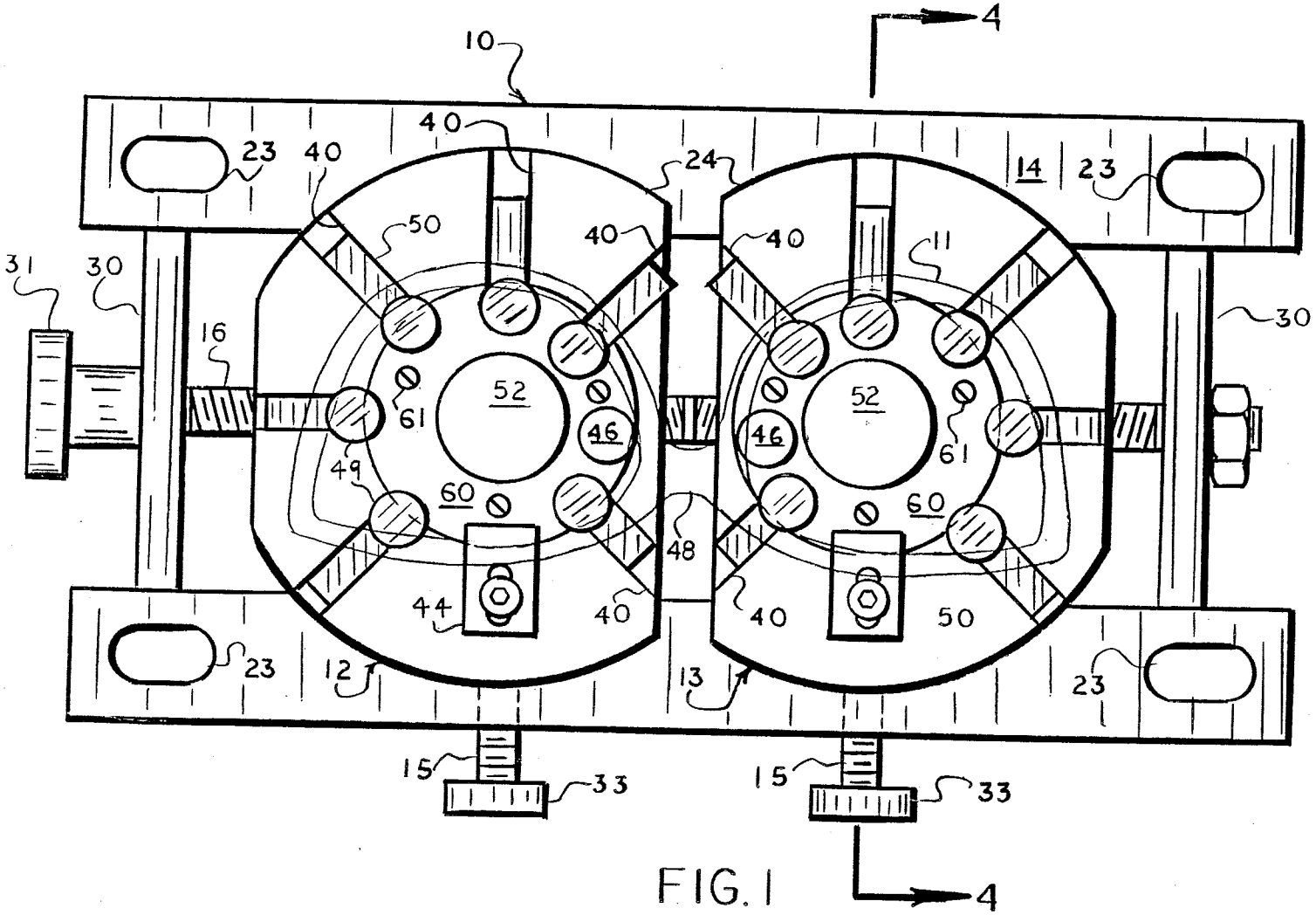
FIG. 1 is a top view of an embodiment of the apparatus of this invention shown in operative association with a finished eyeglass frame.
Figure 2:
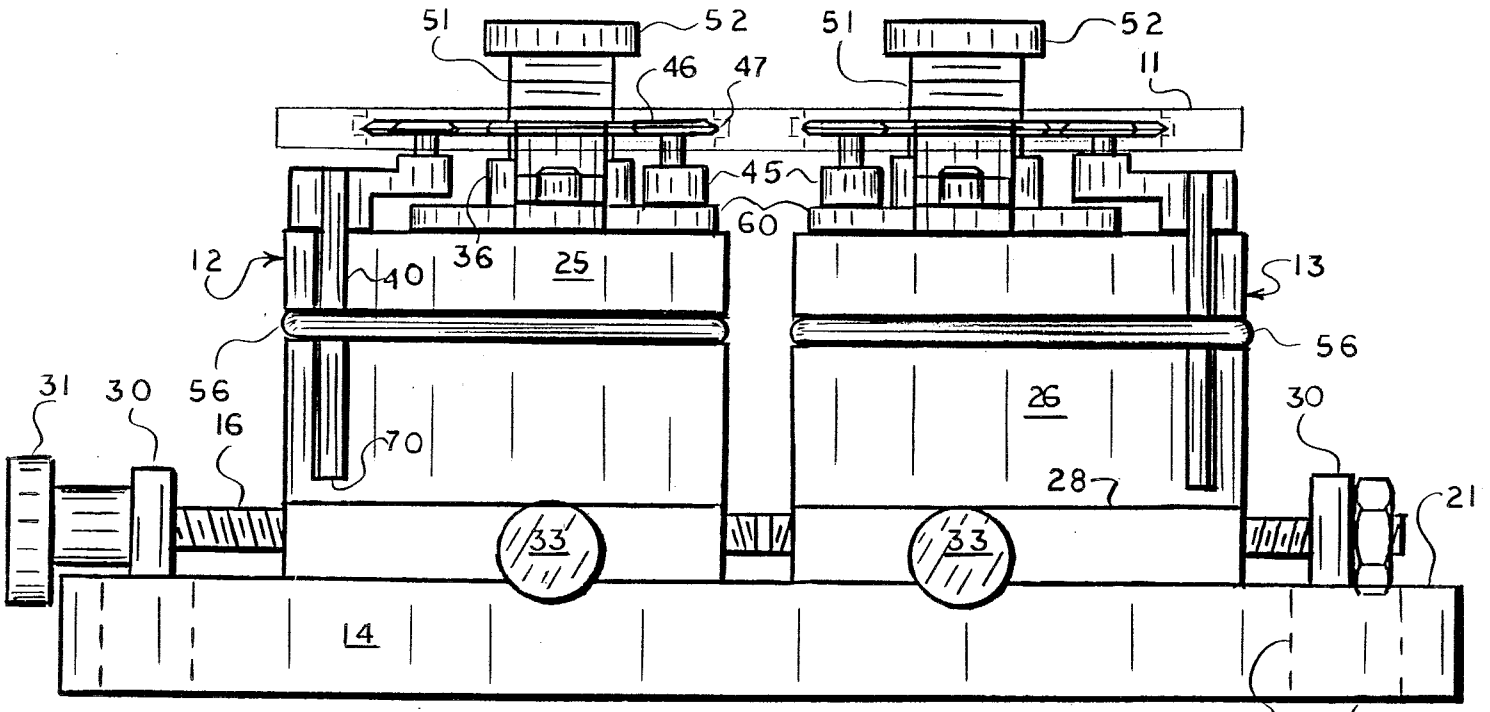
FIG. 2 is a front view of the apparatus of FIG. 1.
Figure 3:
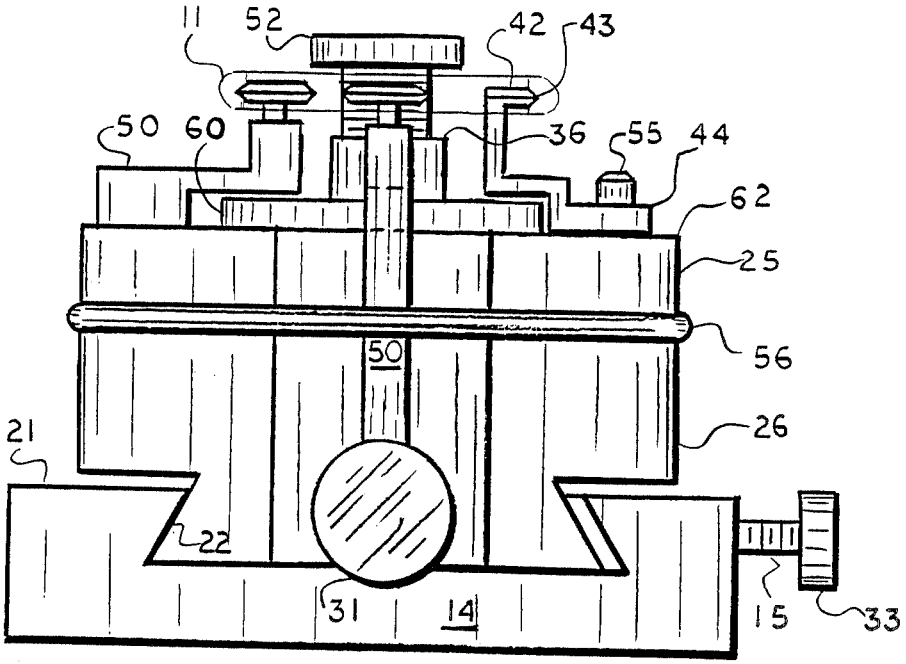
FIG. 3 is an end view thereof, taken from the left side of FIG. 2.

Referring to FIGS. 1–4, an embodiment of the holding apparatus 10 of this invention is shown in operative association with an eyeglass frame 11. The holding apparatus is comprised of left and right chuck assemblies 12 and 13, respectively, slideably positioned upon a rigid base 14, locking means in the form of threaded bolt 15 for securing the chuck assemblies, and threaded rod 16 which controllably moves the chuck assemblies along the base.

Figure 5:
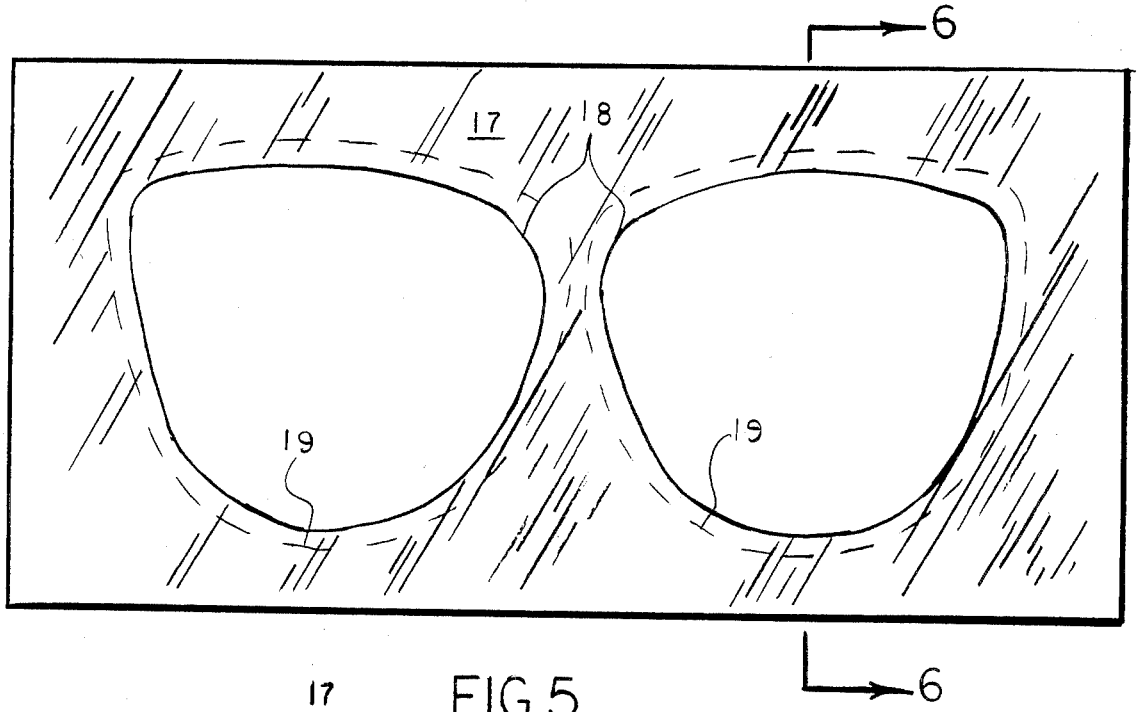
FIG. 5 is a plan view of a plastic panel representing the workpiece accepted by the apparatus of FIG. 1.
Figure 6:
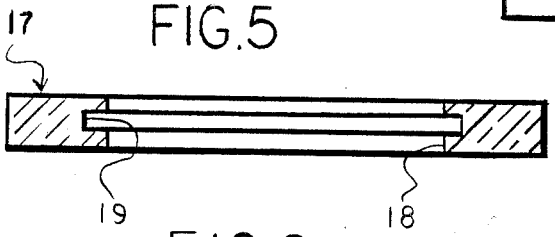
FIG. 6 is a sectional view taken along the line 6—6 of of FIG. 5.

Eyeglass frame 11, representing the finished product produced by apparatus 10, is derived from a flat panel workpiece 17 as shown in FIGS. 5 and 6. Workpiece 17, comprised of a plastic such as cellulose acetate, has a uniform thickness of about ¼", a width of about 3", and a length of about 6". Paired apertures 18, having size and shape ready to receive eyeglass lenses, are cut through the panel. A continuous groove 19 is disposed about the perimeter of each aperture 18 is about mid-depth of the thickness of the panel, the purpose of the groove being to retain the eyeglass lenses.

Base 14 is of substantially rectangular configuration, having a flat bottom 20 and an upper surface 21 having recessed therein track groove 22 running the entire length of the center of the base. Mounting holes 23 are located at the four corners of the base to permit attachment to an underlying support surface such as a table or workbench.

Figure 4:
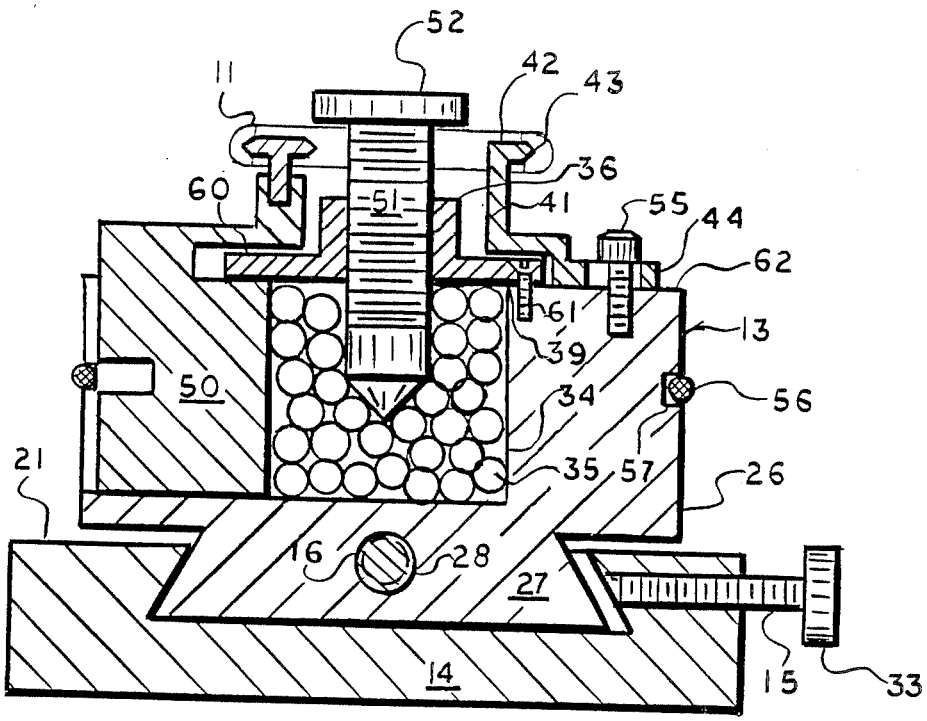
FIG. 4 is a sectional view taken along the line 4—4 of FIG. 1.
Figure 7:
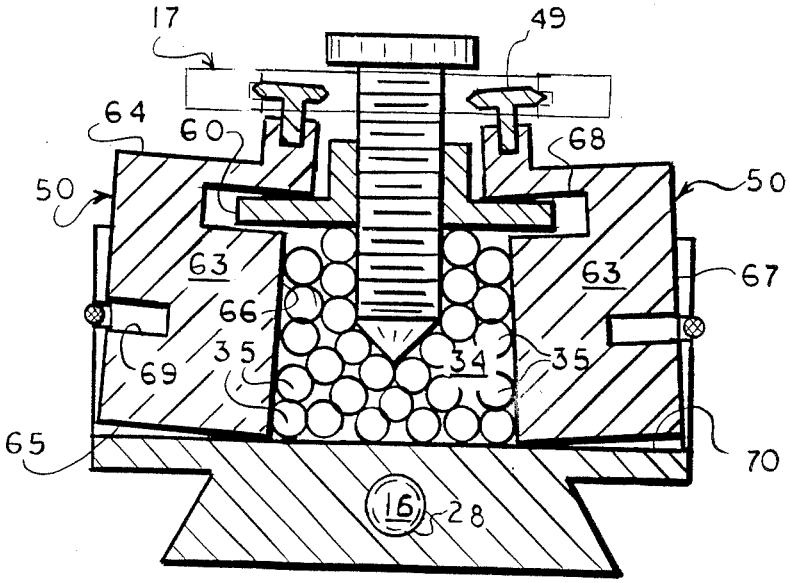
FIG. 7 is a vertical sectional view exemplifying the configuration of isolated components of the holder when a workpiece panel is securely held.

The two chuck assemblies, of mirror-image construction, are each comprised of a housing 24 having upper and lower portions, 25 and 26, respectively, and flat top surface 62. Lower portion 26 is provided with outwardly angled torque 27 adapted to slideably engage groove 22 in base 14. Threaded passageway 28, as best shown in FIGS. 4 and 7, is positioned within each lower portion 26 centered within tongue 27 and parallel thereto. The threading direction within passageway 28 is right-handed in one of the chuck assemblies, and left handed in the other chuck assembly.

Control rod 16 passes through both passageway 28 in threaded engagement therewith, and extends to journaled engagement with bearing blocks 30 mounted upon base 14 adjacent each extremity thereof. Said control rod is provided with two spaced apart sections of threading, one left handed and one right handed, to accommodate the corresponding passageway 28. The left extremity of control rod 16 exterior to bearing block 30 is equipped with a knob 31 to facilitate manual turning. By virture of the aforesaid arrangement of control rod and chuck assemblies, rotation of the knob 31 in one direction causes the chuck assemblies to approach each other. Rotation of the control knob in the opposite direction causes the chuck assemblies to separate from each other. Locking bolts 15 threadably penetrate base 14 at two sites and engage the tongues 27 of each chuck assembly. A knob 33, positioned upon the exterior extremity of each bolt 15 permits manual tightening of each bolt 15 to lock the chuck assemblies in desired positions along track 22.

Upper portion 25 of housing 24 of each chuck assembly is provided with centered chamber 34 whose upper extremity is provided with circular opening 39. The chamber confines a multitude of ball bearings 35. A retainer disc 60 having a circular center aperture is affixed by bolts 61 to top surface 62 of the housing in centered disposition above opening 39. An internally threaded hollow cylindrical hub 36 is welded to retainer disc 60 is centered relationship about the circular aperture in said disc, the diameter of said aperture being at least as great as the internal diameter of hub 36.

Six slots 40 within upper portion 25 and communicating with chamber 34 are oriented in vertical planes radially emergent from chamber 34. The slots are bounded in part by flat bottom surfaces 70 tangentially emergent from the bottom of chamber 34. First holding means, in the form of holding arm 41 is upwardly directed from top surface 62, its upper extremity 42 being adapted to be positioned within aperture 18 of the workpiece panel, and having tapered edge 43 adapted to enter groove 19 of aperture 18 of the workpiece panel. Arm 41 is attached to top surface 62 by apertured foot 44 retained by holding bolt 55 in a manner to permit positonable movement of the arm laterally in a direction perpendicular to the sliding axis of the chuck assemblies.

Second holding means, in the form of positioning post 45, laterally adjustable along the axis of chuck movement, extends upwardly from attachment to top surface 62, terminating in horizontally disposed positioning wheel 46 adapted to be located within aperture 18 of workpiece panel 17. Said wheel 46 is provided with a doubly tapered perimeter which forms a circular edge 47 adapted to enter groove 19 of panel 17. The site at which wheel 46 engages groove 19 is closest to the other aperture 18 of workpiece panel 17, said site ultimately becoming the site of emergence of the nosepiece 48 of the eyeglass frame. The concerted action of positioning wheels 46 of the two chuck assemblies is to limit the separation between the two assemblies against the urging of control rod 16.

Six traveling plates 50 are slidably positioned within slots 40. Each traveling plate, as more clearly shown in FIG. 7, is comprised of opposed parallel flat faces 63 that slidably abut the interior walls of slots 40, upper end surface 64, lower end surface 65, interior end surface 66, and exterior end surface 67. A horizontally disposed upper recess 68 communicates with interior end surface 66. A horizontally disposed lower recess 69 communicates with exterior end surface 67. Positioned upon the upper end surface 64 of each traveling plate is impingement means in the form of horizontally disposed traveling wheel 49, said wheels having the same tapered circular edge as positioning wheel 46 and adapted to engage the groove 19 of aperture 18 of the workpiece panel. The interior end surfaces 66 of the traveling plates communicate with chamber 34. The lower end surface 65 of each traveling plate rides upon bottom surface 70 of its respective slot 40. The upper recesses 68 of the traveling plates slidably engage retainer disc 60.

Closure plug 51, provided with turning knob 52, threadably engages hub 36. When plug 51 is forced downwardly into contact with the ball bearings within chamber 34, the traveling plates 50 are forced radially outwardly, and the circular edges 47 of traveling wheels 49 are caused to engage groove 19 of the aperture of the panel at separate sites and with equal force. At the points of maximum radially outward transport of traveling wheels 49, the plates 50 became mechanically locked. The locking effect, as shown in FIG. 7, is achieved when the lowermost edge of interior end surface 66 contacts bottom surface 70 of the slot, and upper recess 68 grips retainer disc 60 at upper and lower locations. The locking effect is achieved by virtue of the outward tilting of the upper portion of plate 50 as little as 0.005 inch. The tilting is achieved by virtue of the pressure of balls 35 acting against interior end surface 66 of traveling plate 50.

Once secured in the aforesaid manner, the outer periphery of the plastic workpiece panel can be subjected to a milling operation to produce the sought eyeglass frame.

An O-ring 56 is seated within retaining groove 57 surrounding each chuck. The function of the O-ring is to restrain traveling plates 50 with respect to uncontrolled outward movement, and to facilitate manual return of the plates to their starting positions.

In the process of the present invention, the several traveling wheels or equivalent alternative impingement means which may number 4–8, are moved to their innermost positions, and knob 52 is turned to an elevated position. A workpiece panel is then placed upon the holder so that turning knobs 52 extend upwardly through apertures 18 of workpiece panel 17. Knob 31 is then turned, causing position wheels 46 to grip groove 19 within the apertures of the workpiece. Holding arm 41 is adjusted to further position groove 19. With the workpiece properly located in the aforesaid manner, knob 52 is turned to a downward position, causing radial movement of the impingement means and attendant locking of the workpiece with sufficient strength to permit a milling operation.

While particular examples of the present invention have been shown and described, it is apparent that changes and modifications may be made therein without departing from the invention in its broadest aspects. The aim of the appended claims, therefore, is to cover all such changes and modifications as fall within the true spirit and scope of the invention.

Having thus described my invention, what is claimed is:

1. An apparatus for holding a plastic workpiece panel of elongated outer periphery for the production of an eyeglass frame, said panel having two lens-holding apertures of mirror image identity substantially centered upon the axis of elongation of the panel, each aperture having a groove circumscribing its entire perimeter centered within the thickness of the panel and adapted to receive the edges of the lenses which will be inserted into the finished frame, said apparatus comprising:

(a) a rigid base having means for attachment to an underlying substrate, (b) paired chuck assemblies of mirror image identity slideably positionable upon said base along a common horizontal axis, (c) means for causing sliding motion of said chuck assemblies upon said base, (d) means for locking each chuck assembly in a desired location upon said base, (e) each chuck assembly comprising:

(1) a housing having a lower portion which engages said motion causing means, an upper portion having a chamber which confines a multitude of ball bearings, said chamber having an upwardly directed opening, a cylindrical threaded hub disposed above said opening and having a hollow interior that communicates with said chamber, and slots oriented in vertical planes radially emergent from said chamber, (2) first holding means laterally positionable in a direction perpendicular to said common horizontal axis and adapted to engage the groove within an aperture of said workpiece panel, (3) second holding means adapted to engage the groove within an aperture of said workpiece panel at a site closest to the other aperture, said site ultimately becoming the nosepiece of the eyeglass frame, the concerted action of the second holding means of the two chuck assemblies being to limit the separation between the two assemblies against the urging of said means for causing sliding motion along said horizontal axis, (4) a number of impingement means moveable radially with respect to said hub, and adapted to contact the workpiece panel at different sites within the apertures thereof, each impingement means being supported by an underlying traveling plate communicating with said chamber and constrained to slide within said slots, and (5) closure means which treadably engages said hub and, by rotation moves downward to apply force to the multitude of ball bearings, whereby (f) said traveling plates are independently driven radially outwardy from said hub, carrying said impingement means which abut with equal force against the perimeter of the aperture, whereby (g) the workpiece panel is securely and precisely held without distortion in a manner to permit milling of its outer periphery to produce the sought eyeglass frame.

2. The apparatus of claim 1 wherein said impingement means number between 4 and 8.

3. The apparatus of claim 1 wherein the sliding interaction of the base with the chuck assemblies is achieved by way of tongue and groove track structure operative between the upper portion of the base and lower portion of the chuck assemblies.

4. The apparatus of claim 1 wherein means are provided to limit the extent of radially outward movement of said traveling plates.

5. The apparatus of claim 1 wherein each plate has an elongated recess that opens in the direction of said chamber.

6. The apparatus of claim 5 wherein said recess slidably engages a horizontally disposed disc mounted upon the upper portion of said housing.

7. The apparatus of claim 4 wherein said means for limiting outward movement of the plates comprises an O-ring that surrounds the chuck assembly.

* * * * *